US011052980B2

(12) United States Patent
Zhou

(10) Patent No.: US 11,052,980 B2
(45) Date of Patent: Jul. 6, 2021

(54) UNDERARM FLOAT FOR INFANTS

(71) Applicant: Zhejiang Mambobaby Baby Products Co., Ltd., Yiwu (CN)

(72) Inventor: Weixin Zhou, Jinhua (CN)

( * ) Notice: Subject to any disclaimer, the term of this patent is extended or adjusted under 35 U.S.C. 154(b) by 0 days.

(21) Appl. No.: 16/989,918

(22) Filed: Aug. 11, 2020

(65) Prior Publication Data

US 2020/0369354 A1 Nov. 26, 2020

(30) Foreign Application Priority Data

Jan. 21, 2020 (CN) ..... 202020137971.1

(51) Int. Cl.
*B63C 9/00* (2006.01)
*B63C 9/13* (2006.01)

(52) U.S. Cl.
CPC ..... *B63C 9/13* (2013.01)

(58) Field of Classification Search
CPC ..... B63C 9/13; B63C 9/135; B63C 2009/133; A47D 13/04
See application file for complete search history.

(56) References Cited

U.S. PATENT DOCUMENTS 2,075,374 A * 3/1937 Tucker ..... B63B 34/50 441/131
6,126,504 A * 10/2000 Day ..... A47C 15/006 441/129
8,523,742 B2 * 9/2013 Lam ..... A47D 13/04 482/66
2013/0065210 A1 * 3/2013 Perrine ..... A47D 13/046 434/255

FOREIGN PATENT DOCUMENTS

CN 208837433 U * 5/2019
DE 507603 C * 9/1930 ..... B63C 9/135
FR 447213 A * 12/1912 ..... B63C 9/135
FR 2186922 A5 * 1/1974 ..... B63C 9/155
NL 2022708 B1 * 10/2019 ..... A63B 31/00

* cited by examiner

*Primary Examiner* — Andrew Polay
(74) *Attorney, Agent, or Firm* — HYIP

(57) ABSTRACT

An underarm float for infants, comprising a main body, the main body is composed of a front part and rear parts, which are connected to each other, wherein rear parts are connected to both ends of the front part, and rear parts at the two ends of front part are oppositely arranged; a first arc groove and second arc grooves are formed at the joint between front part and a rear part, first arc groove is downwards recessed along the upper surface of the front part and the rear part, and the second arc grooves are inwards recessed along the side surface of the front part and the rear part; a shoulder strap is arranged at the joint between the front part and the rear part, and the shoulder strap is located above the first arc groove; and the oppositely arranged rear parts are provided with an elastic cord.

10 Claims, 2 Drawing Sheets

UNDERARM FLOAT FOR INFANTS

TECHNICAL FIELD

The present invention belongs to the technical field of swimming floats, and particularly relates to an underarm float for infants.

BACKGROUND

The swimming floats generally involve the children and the young generation. The swimming floats have the characteristics of safety, hygiene and novelty, and are the best products for baby fitness and games. The swimming floats are cute in shape, attractive in style, bright in color, convenient to carry, and not bored to play, and are newest playmates for babies.

The existing swimming floats are usually of a ring structure. In the using process, because children of different ages have different arm lengths, there is a need to select swimming floats of different sizes. Because the arms of children need to be placed on the swimming floats, swimming floats of inappropriate sizes are not convenient for children to use and paddle. Meanwhile, because the arms of children need to be placed on the swimming floats, and the swimming floats usually have a wide size, it is difficult for the arms of children to touch water when placed on the swimming floats, and the center of gravity of the children is higher under the action of the swimming floats, having a risk of turnover, and after the children use the traditional swimming floats for a period of time, the arms may be sore as the arms are placed on the swimming floats, having a risk of slipping out of the swimming floats.

SUMMARY

To overcome the defects in the above background, the present invention provides an underarm float for infants, which is low in center of gravity, not easy to slip, and safe and reliable.

To achieve the above purpose, the present invention adopts the following technical solution: an underarm float for infants, comprising a main body of a hollow structure, the main body being composed of a front part and rear parts, which are connected to each other, wherein the rear parts are connected to both ends of the front part, and the rear parts at the two ends of the front part are oppositely arranged; a first arc groove and second arc grooves are formed at the joint between the front part and a rear part, the first arc groove is downwards recessed along the upper surface of the front part and the rear part, and the second arc grooves are inwards recessed along the side surface of the front part and the rear part, a shoulder strap is arranged at the joint between the front part and the rear part, and the shoulder strap is located above the first arc groove, and the oppositely arranged rear parts are provided with a first connecting piece.

As a preferred solution of the present invention, the first arc groove and the second arc grooves are located in the middle position of the main body.

As a preferred solution of the present invention, the main body is of a ring structure, the front part and the rear parts are integrated in one piece, and a clearance is formed between the oppositely arranged rear parts.

As a preferred solution of the present invention, each of the front part and the rear parts is of an arc structure, and an annular hollow structure is formed by the front part and the rear parts.

As a preferred solution of the present invention, the shoulder strap comprises a first connecting strap and a second connecting strap, wherein the bottom of the first connecting strap is connected with the front part, and the second connecting strap is connected with the rear part.

As a preferred solution of the present invention, the first connecting strap is provided with multiple rows of female snap fasteners, the multiple rows of female snap fasteners are arranged in the length direction of the first connecting strap, and the second connecting strap is provided with male snap fasteners that match the female snap fasteners.

As a preferred solution of the present invention, the first connecting strap is connected with the second connecting strap by a hook & loop.

As a preferred solution of the present invention, a second connecting piece is connected between the oppositely arranged rear parts.

As a preferred solution of the present invention, the front part is provided with a headrest.

As a preferred solution of the present invention, the main body is made of a foam material.

The present invention has the following beneficial effects that compared with the prior art, by means of the arrangement of the first arc grooves and the second arc grooves, it is easier for the arms of a child to touch water, and the center of gravity of the child is lower, making the swimming float have better stability and fun during use; and by means of the adjustable arrangement of the shoulder straps and the rear parts, the float is suitable for children of different body sizes, making it difficult for a child to slip out of the swimming float.

Figure 1:
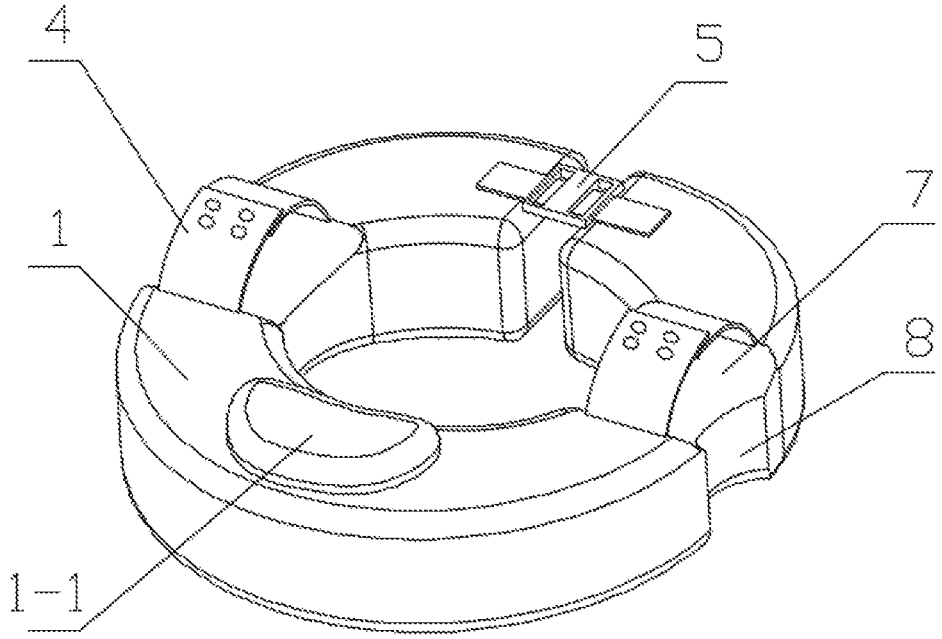
FIG. 1 is a structural schematic diagram of the present invention.

Reference numerals in the figures: main body 1; headrest 1-1; front part 2; rear part 3; shoulder strap 4; first connecting strap 4-1; second connecting strap 4-2; second connecting piece 5; first connecting piece 6; first arc groove 7; second arc groove 8.

DETAILED DESCRIPTION

The embodiments of the present invention are described in detail below in combination with the drawings.

Figure 2:
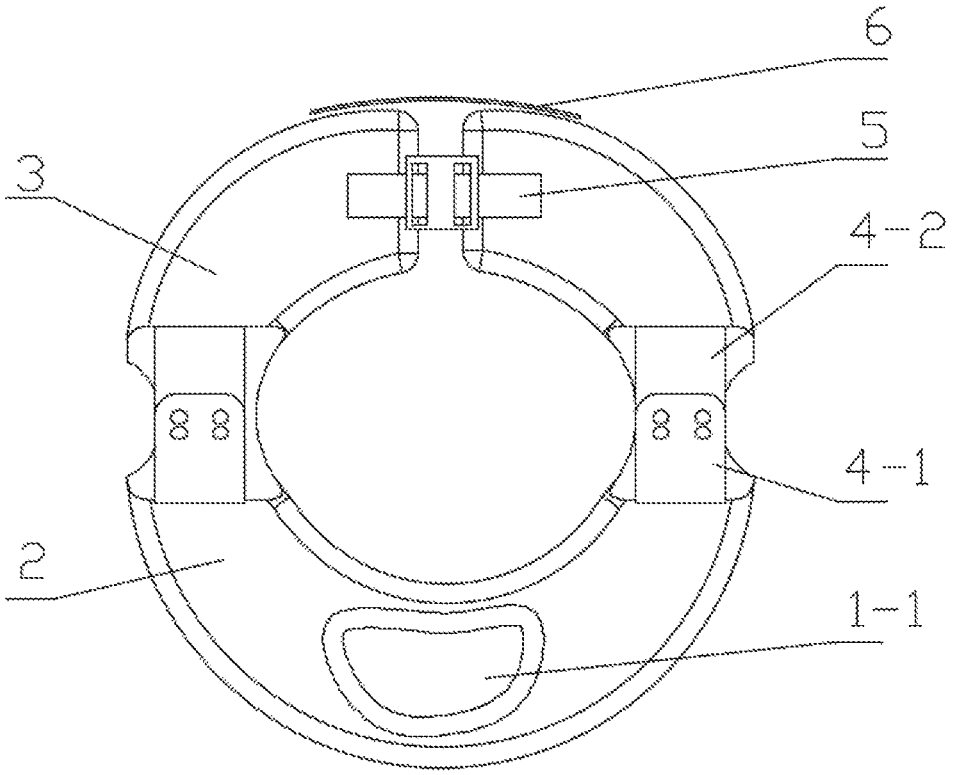
FIG. 2 is a top view of the present invention.
Figure 3:
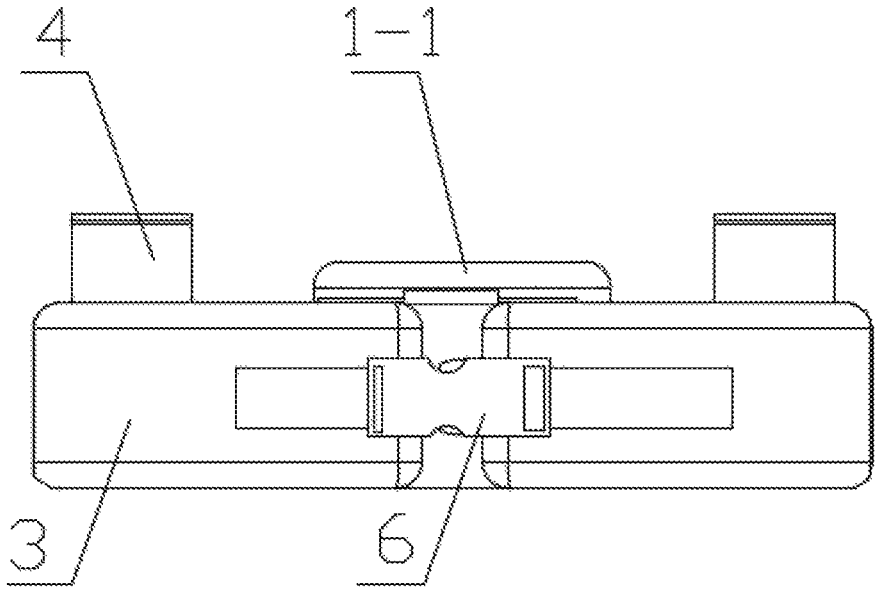
FIG. 3 is a front view of the present invention.
Figure 4:
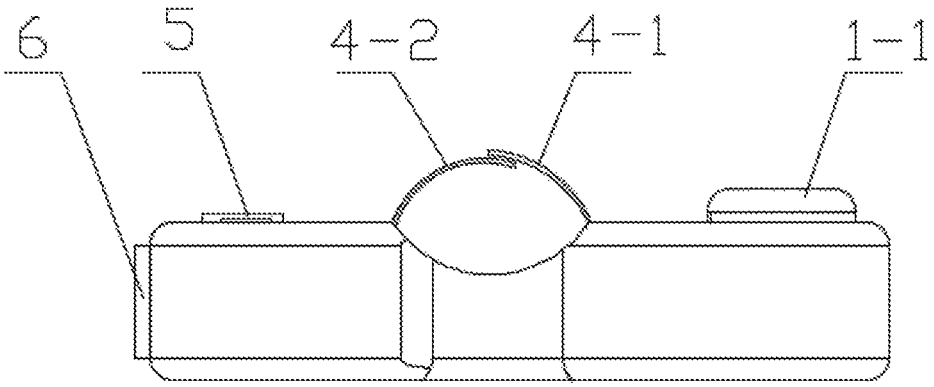
FIG. 4 is a left view of the present invention.

As shown in FIGS. 1-4, an underarm float for infants, comprising a main body 1, the main body 1 being composed of a front part 2 and rear parts 3, which are connected to each other, wherein the rear parts 3 are connected to both ends of the front part 2, and the rear parts 3 at the two ends of the front part 2 are oppositely arranged; a first arc groove 7 and second arc grooves 8 are formed at the joint between the front part 2 and a rear part 3, the first arc groove 7 is downwards recessed along the upper surface of the front part 2 and the rear part 3, and the second arc grooves 8 are inwards recessed along the side surface of the front part 2 and the rear part 3; a shoulder strap 4 is arranged at the joint between the front part 2 and the rear part 3, and the shoulder strap 4 is located above the first arc groove 7, and the oppositely arranged rear parts 3 are provided with a first connecting piece 6, and the first connecting piece 6 is configured to connect or disconnect the oppositely arranged rear parts 3.

The first arc groove 7 is of an arc groove structure with an opening facing upwards, the second arc grooves 8 are located on the inner and outer sides of the joint between the front part 2 and the rear part 3, the opening of the second arc groove 8 located on the inner side the joint between the front part 2 and the rear part 3 faces inwards, and the opening of the second arc groove 8 located on the outer side of the joint between the front part 2 and the rear part 3 faces outwards Under the action of the first arc groove 7 and the second arc grooves 8, the joint between the front part 2 and the rear part 3 is small in size.

The first arc grooves 7 and second arc grooves 8 are respectively formed at the joints between the two ends of the front part 2 and the rear parts 3, and the first arc grooves 7 and the second arc grooves 8 at the joints between the two ends of the front part 2 and the rear parts 3 are oppositely arranged. The joints between the front part 2 and the rear parts 3 are configured to place the arms of a child. Under the action of the first arc groove 7 and the second arc grooves 8, it is easier for the arms of the child to touch water, and the center of gravity of the child is lower, making the float have better stability during use. Meanwhile, because the first arc groove 7 and the second arc grooves 8 are located in the middle position of the main body 1, the center of gravity is at the middle position of the main body 1, preventing the main body 1 from turning over.

The main body 1 is of a ring structure, the front part 2 and the rear parts 3 are integrated in one piece, a clearance is formed between the oppositely arranged rear parts 3, and the size of the hollow structure in the main body 1 is adjusted by adjusting the size of the clearance, thereby being suitable for children of different ages Each of the front part 2 and the rear parts 3 is of an arc structure, and an annular hollow structure is formed by the front part 2 and the rear parts 3. When the body of the child is situated in the annular hollow structure, under the action of the annular hollow structure, a larger contact area is formed between the body of the child and the main body 1, thereby making the float more stable.

The shoulder strap 4 comprises a first connecting strap 4-1 and a second connecting strap 4-2, wherein the bottom of the first connecting strap 4-1 is fixedly connected with the front part 2 by sewing, and the second connecting strap 4-2 is fixedly connected with the rear part 3 by sewing, each arm of the child is wrapped by the shoulder strap 4 and the first arc groove 7, the shoulder strap 4 is detachably connected under the action of the first connecting strap 4-1 and the second connecting strap 4-2, and an arc-shaped through hole is formed between the shoulder strap 4 and the first arc groove 7.

The arm of the child can be placed on the first arc groove 7 by passing through the arc-shaped through hole formed between the shoulder strap 4 and the shoulder strap 4, the arm of the child can be placed on the first arc groove 7 by disconnecting the first connecting strap 4-1 from the second connecting strap 4-2, and then the arm of the child can be wrapped by the shoulder strap 4 and the first arc groove 7 by re-connecting the first connecting strap with the second connecting strap 4-2, thereby preventing the child from slipping.

The first connecting strap 4-1 is provided with multiple rows of female snap fasteners, the multiple rows of female snap fasteners are arranged in the length direction of the first connecting strap 4-1, and the second connecting strap 4-2 is provided with male snap fasteners that match the female snap fasteners. The number of rows of the female snap fasteners may be designed according to actual needs, the male snap fasteners may be connected with different rows of female snap fasteners according to actual needs, and the tightness of the shoulder strap 4 may be adjusted according to different sizes of the arms of children.

The first connecting strap 4-1 and the second connecting strap 4-2 may be connected by a hook & loop. The first connecting strap 4-1 and the second connecting strap 4-2 are provided with hook and loop which match with each other, and the tightness of the shoulder strap 4 is adjusted according to different sizes of the arms of children.

A first connecting piece 6 is connected between the oppositely arranged rear parts 3, and the second connecting piece 5 is configured to adjust the size of the clearance between the oppositely arranged rear parts 3. After the adjustment of the second connecting piece 5, the oppositely arranged rear parts 3 are fixedly connected by the first connecting piece 6, so that the oppositely arranged rear parts 3 have better stability. The second connecting piece 5 may be of a buckle, hook & loop or rope structure.

The front part 2 is provided with a headrest 1-1, the headrest 1-1 is located in the middle position of the front part 2, and the headrest 1-1 is upwards protruded along the upper surface of the front part 2, to facilitate children to rest when they are tired from swimming.

The main body 1 is made of a foam material, and the main body 1 may be a soft foam structure. By taking plastic and rubber as raw materials, and adding catalyst, foam stabilizer, foaming, agent and other auxiliary materials, a large number of fine foams appear in the plastic and rubber through physical foaming or cross-linking foaming, increasing the volume and reducing the density. A cloth sleeve is sleeved outside the main body 1.

The above description of the disclosed embodiments enables those skilled in the art to realize or use the present invention. Many modifications to these embodiments will be apparent to those skilled in the art. The general principle defined herein can be realized in other embodiments without departing from the spirit or scope of the present invention. Therefore, the present invention will not be limited to these embodiments shown herein, but will conform to the widest scope consistent with the principle and novel features disclosed herein.

Although more reference numerals in the figures are used in the present invention such as main body 1, headrest 1-1, front part 2, rear part 3, shoulder strap 4, first connecting strap 4-1, second connecting strap 4-2, second connecting piece 5, first connecting piece 6, first arc groove 7, second arc groove 8 and other terms, the possibility of using other terms is not excluded. These terms are only used to describe and explain the essence of the present invention more conveniently. It is contrary to the spirit of the present invention to explain these terms as any additional limitation.

The invention claimed is:

1. An underarm float for infants, comprising a main body (1), the main body (1) being composed of a front part (2) and rear parts (3), which are connected to each other, wherein the rear parts (3) are connected to both ends of the front part (2), and the rear parts (3) at the two ends of the front part (2) are oppositely arranged; a first arc groove (7) and second arc grooves (8) are formed at the joint between the front part (2) and a rear part (3), the first arc groove (7) is downwards recessed along the upper surface of the front part (2) and the rear part (3), and the second arc grooves (8) are inwards recessed along the side surface of the front part (2) and the rear part (3), a shoulder strap (4) is arranged at the joint between the front part (2) and the rear part (3), and the shoulder strap (4) is located above the first arc groove (7), and the oppositely arranged rear parts (3) are provided with a first connecting piece (6).

2. The underarm float for infants according to claim 1, wherein the first arc groove (7) and the second arc grooves (8) are located in the middle position of the main body (1).

3. The underarm float for infants according to claim 1, wherein the main body (1) is of a ring structure, the front part (2) and the rear parts (3) are integrated in one piece, and a clearance is formed between the oppositely arranged rear parts (3).

4. The underarm float for infants according to claim 1, wherein each of the front part (2) and the rear parts (3) is of an arc structure, and an annular hollow structure is formed by the front part (2) and the rear parts (3).

5. The underarm float for infants according to claim 1, wherein the shoulder strap (4) comprises a first connecting strap (4-1) and a second connecting strap (4-2), wherein the bottom of the first connecting strap (4-1) is connected with the front part (2), and the second connecting strap (4-2) is connected with the rear part (3).

6. The underarm float for infants according to claim 5, wherein the shoulder strap (4) is telescopically connected to the main body (1).

7. The underarm float for infants according to claim 6, wherein the first connecting, strap (4-1) is connected with the second connecting strap (4-2) by a hook & loop or snap fastener.

8. The underarm float for infants according to claim 1, wherein a second connecting piece (5) is connected between the oppositely arranged rear parts (3).

9. The underarm float for infants according to claim 1, wherein the front part (2) is provided with a headrest (1-1).

10. The underarm float for infants according to claim 1, wherein the main body (1) is made of a foam material.

* * * * *